US005353924A

United States Patent [19]

Jaffee

[11] Patent Number: 5,353,924

[45] Date of Patent: Oct. 11, 1994

[54] COIN CASSETTE

[75] Inventor: Max Jaffee, Studio City, Calif.

[73] Assignee: Edmund Amzallag, Encino, Calif.

[21] Appl. No.: 80,476

[22] Filed: Jun. 18, 1993

[51] Int. Cl.[5] ..... A45C 1/00; B65D 43/20

[52] U.S. Cl. ..... 206/0.83; 206/0.82; 206/0.84; 206/445; 220/8; 220/345

[58] Field of Search ..... 206/0.8–0.84, 206/445; 220/345, 346, 8

[56] References Cited

U.S. PATENT DOCUMENTS

| | | | |
|---|---|---|---|
| 1,658,496 | 2/1928 | Quarnstrom | 220/8 X |
| 2,117,516 | 5/1938 | Skidelsky | 220/345 X |
| 2,550,437 | 4/1951 | Yates | 206/0.84 X |
| 2,690,200 | 9/1954 | Page | 206/0.84 |
| 2,892,537 | 6/1959 | Schwartz | 206/0.81 |
| 3,441,165 | 4/1969 | Zamprehelli | 220/345 X |
| 3,730,602 | 5/1973 | Campbell et al. | 206/445 X |
| 3,837,475 | 9/1974 | Bolanz | 206/0.8 |
| 3,957,157 | 5/1976 | Theman | 206/0.83 |
| 4,033,452 | 7/1977 | Themen | 206/0.83 |
| 5,114,014 | 5/1992 | Ascahon et al. | 206/0.84 |

*Primary Examiner*—Bryon P. Gehman
*Attorney, Agent, or Firm*—Frank L. Zugelter

[57] ABSTRACT

A coin cassette (10) formed by a channeled sleeve (11) in which a cartridge (12) is slidably mounted between the two open ends (25, 26) of the sleeve (11). The cartridge (12) includes variously-sized slotted formations (43) for coins (55). Ribs (31, 32) on the cartridge (12) mate with corresponding grooves (21, 22) in the sleeve's panels (13, 14) to provide direction of sliding motion of the cartridge (12) out of the sleeve (11). Stop members (33, 34) are mounted on the top edges (17, 18) of the panels (13, 14), for engagement with ears (35, 36) on the sides (46, 48) of the cartridge (12) to restrict its extent of sliding motion, preventing it from being separated from its sleeve (11). A serrated thumb pad (19) on a sleeve panel (13) provides for gripping the sleeve (11) in the casette's operation.

45 Claims, 2 Drawing Sheets

COIN CASSETTE

BACKGROUND OF THE INVENTION

1. Field of the Invention

This invention relates to a pocket sized coin receptacle or holder, and is more particularly directed to a cassette having a coin-holding cartridge slidably but restrictively mounted in a sleeve, and from which coins are stored in or dispensed from the receptacle.

2. Identification of Known Related Art

Various kinds of coin receptacles are disclosed in the following prior art teachings, hereby made of record: U.S. Pat. Nos. 1,470,358; 2,600,311; 2,550,437; and 4,033,452.

SUMMARY OF THE INVENTION

The invention is encompassed within a cassette comprising a sleeve and a cartridge slidably mounted therein. The materials forming the sleeve and cartridge are lightweight, yet sturdy, for long time usage under normal handling conditions. Both the sleeve and the cartridge are manufactured in precision-like manner through injection molding techniques known and utilized in the plastic industry.

The sleeve is rectangularly configured, forming a channel between a pair of spaced panels joined together along a bottom for the sleeve, with an open top opposing the bottom and with open ends opposing one another between its top and bottom. The cartridge contains variously sized and angularly-oriented (with respect to itself) configurations or slotted formations for coins, and is generally substantially co-extensive with the length and width of the sleeve while being slidably mounted therein, movable back and forth through its open ends. Means for maintaining the direction of such sliding motion through such open ends are provided by means of cooperating ribs and grooves formed in the walls of the cartridge and sleeve, respectively, they generally being coextensive with the lengths of their corresponding cartridge and sleeve in which they are formed. Along the edges of the sleeve forming its open top there are nonaligned stop members raised above such edges, each of such stop members being disposed inwardly from a corresponding open end of the sleeve. An ear, in the form of a lug or boss, is fixedly mounted to and protrudes laterally from each side of the cartridge, in non-aligned fashion to each other, adjacent its top edge, for cooperative engagement with its corresponding one of such stop members on the sleeve, to thereby restrict such sliding motion, i.e., to prevent the cartridge from sliding completely out of such open ends and thereby being free of or separated from its sleeve. Dispensing of the coins from their slotted formations nevertheless is readily attained. The formation of the sleeve's panels to its bottom provides a flexible or snapping characteristic to such panels so that should it be desired to remove the cartridge from its sleeve, the panels can be flexed away from one another to easily remove such cartridge, through the open top of or through the open ends of the sleeve, the ears by-passing their corresponding stop members.

Each of the configurations or body formations which forms a slot for storing coins, such as pennies, nickels, dimes, and quarters, includes a pillow or wedge-like formation located at its closed or inner most end, for seating a first correspondingly-sized coin inserted into the slot, and providing, along with rails of an annular groove that forms the slot, a frictional gripping or wedging on such first coin in such slot. Each one of a plurality of correspondingly-sized coins that is subsequently inserted into the slot is seated on the coin that has been wedged in place either on the pillow or on the immediately pre-deposited coin in the slot, and thus also is wedged and held in its position in its slot, not coming out of it by its own accord.

A thumb pad is provided on the sleeve for use by the operator of the cassette, it being gripped by the thumb as the cartridge is extended in its sliding motion from the sleeve.

By sliding the cartridge through one or the other of such open ends, one or more coins are readily manually insertable or dispensable from its corresponding slot, thus providing a convenient mode for depositing and dispensing of coins that are or are not to be retained in the receptacle or cassette.

An object of this invention is to provide a lightweight, sturdy, and conveniently built cassette for coins.

Another object of the invention is to provide a novel article for storing coins.

A further object of the invention is to provide a lightweight, pocket-sized receptacle for depositing, retaining, and dispensing of coins.

A still further object of the invention is to provide a readily snapable-together-and-releasable-cartridge-to-sleeve receptacle or cassette.

These and other objects are advantages will become more apparent upon a full and complete reading of the following description, the appended claims thereto, and the accompanying drawing comprising two (2) sheets of seven (7) FIGURES.

DESCRIPTION OF THE PREFERRED EMBODIMENT(S)

Figure 1:
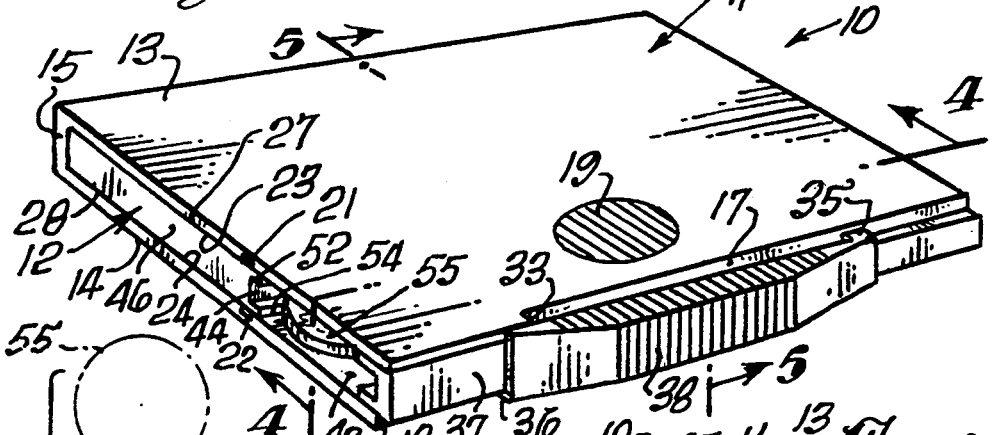
FIG. 1 is a perspective view of the subject matter of the invention.
Figure 2:
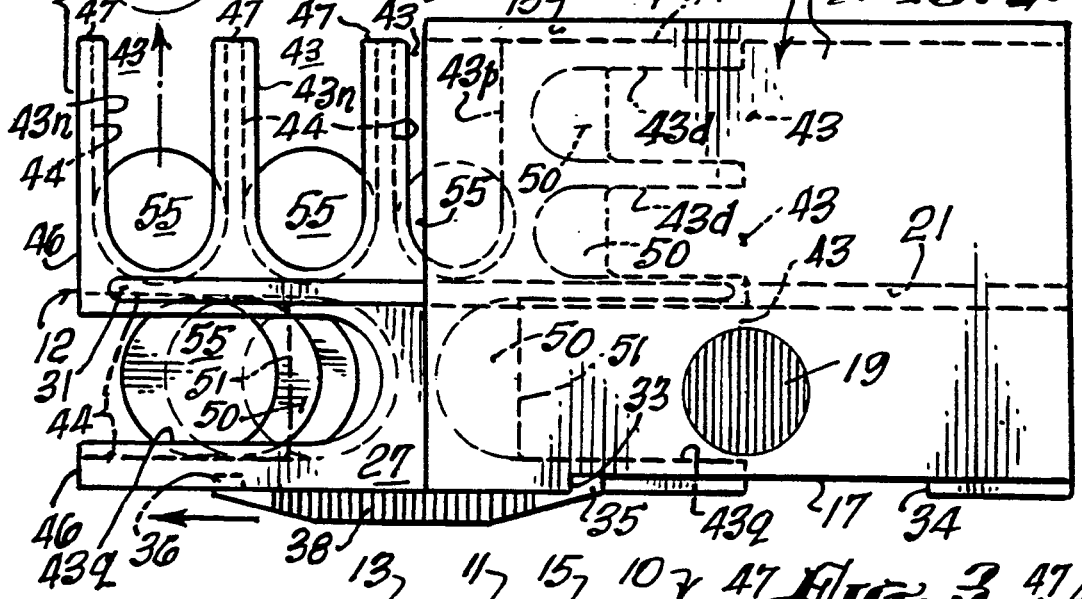
FIG. 2 is a plan or side view of such subject matter, with its cartridge showing fully extended in one of its two possible directions from its sleeve yet restricted thereto.
Figure 3:
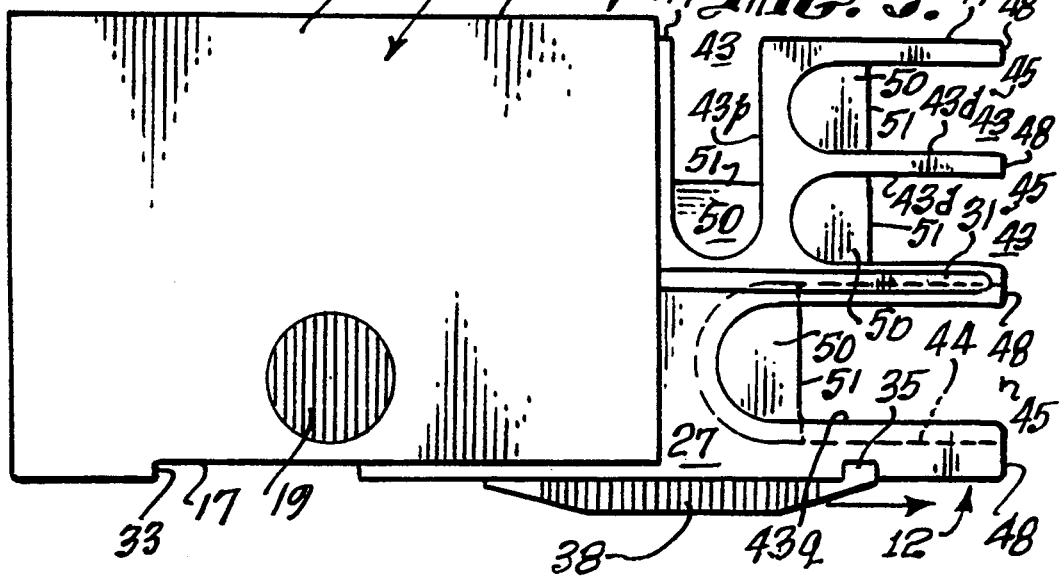
FIG. 3 is the same side view of FIG. 2, but showing the cartridge fully projected or extended in the opposite direction.

Referring now to the drawing wherein reference characters correspond to like numerals hereinafter, FIG. 1 illustrates an assembled coin cassette or receptacle 10 comprising a sleeve 11 to which a cartridge 12 is assembled, the FIGURE showing the assembly in closed position. Sleeve 11 comprises, FIG. 1, 6, a pair of rectangularly-configured panels 13, 14 spaced from one another to form a channel and held in such spaced relation by an integrally formed co-extensive bottom spacer member 15 joining the two panels together. Opposing the bottom spacer member 15 is an open top 16, FIG. 6, for the sleeve, formed by and between top edges 17, 18, of the panels 13, 14, respectively. A thumb pad 19, in serrated form, is mounted on the outside of the one panel 13, generally midway of the sleeve's length for gripping the sleeve 11 in operation of the invention. The preferred size of sleeve 11, and thus the cassette 10 when in closed condition, is such as to be reasonably disposable within pocket dimensions of a piece of apparel, such as a pants or skirt pocket, a purse, or the like, thus defining substantially the fullest dimensions for the cassette 10 itself when in closed position.

Figures 4, 5, 6, 7:
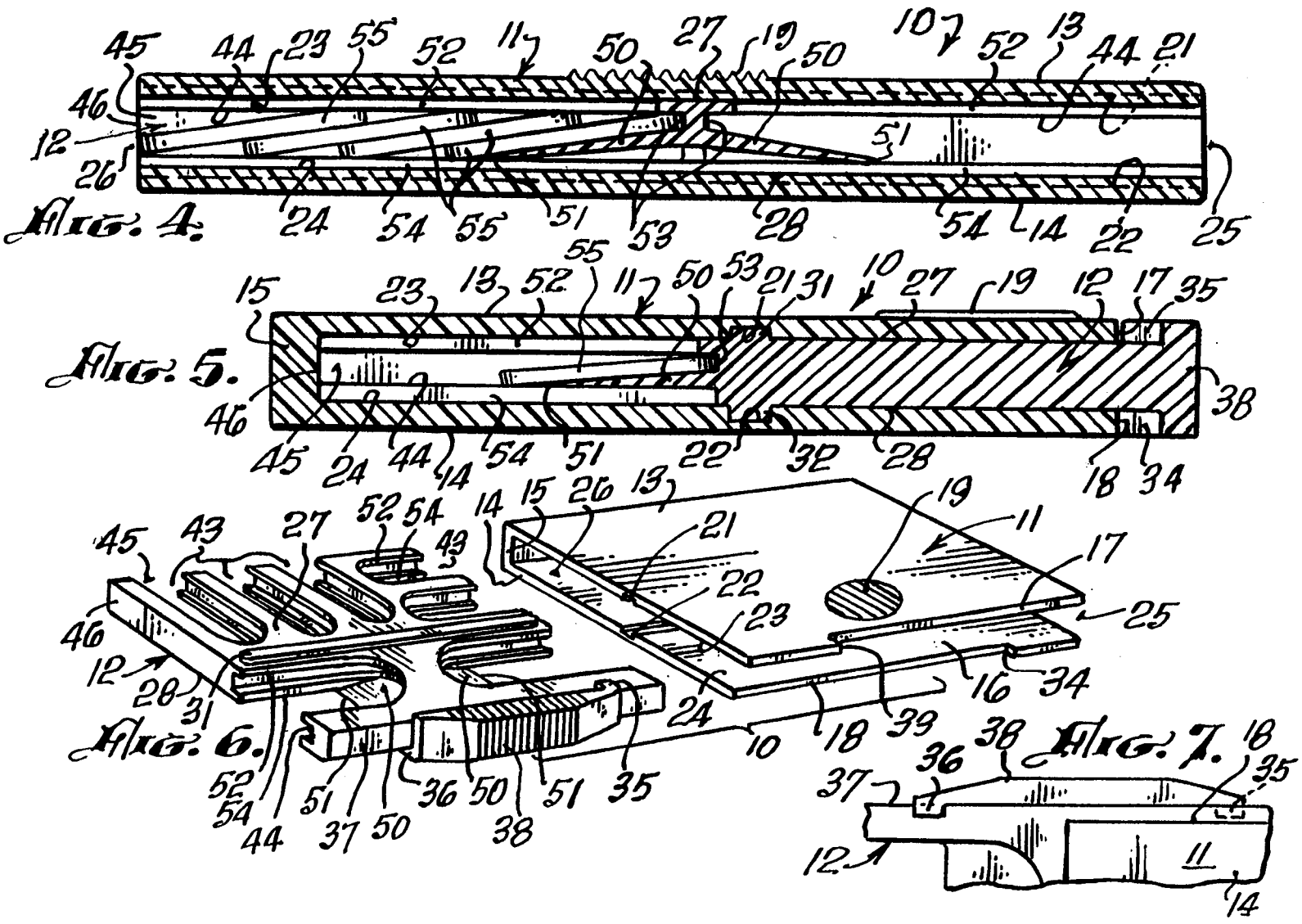
FIG. 4 is a view taken on line 4—4 of FIG. 1.
FIG. 5 is a view taken on line 5—5 of FIG. 1.
FIG. 6 is an exploded perspective view of the cartridge and sleeve, prior to the assembly of one to the other.
FIG. 7 is a fragmentary side view of cartridge assembled to sleeve yet partially extended in one direction from sleeve, showing a disposition on the cartridge of an ear (36) hidden from view in FIG. 2 but shown in FIG. 6, and like the ear (35) on the cartridge shown in FIG. 2.

Along or in the height of each panel 13, 14, FIGS. 5, 6, grooves 21, 22, respectively, are formed within the interior walls 23, 24 of their corresponding panels 13, 14, extending between side edges forming open ends 25, 26 in sleeve 11. Along each of sides 27, 28 formed in cartridge 12, a corresponding rib 31, 32 is formed and projects therefrom, to mate by engagement with its corresponding groove 21, 22 formed in the interior walls 23, 24 of sleeve 11 in the assembly of cartridge to sleeve. The thickness of cartridge cartridge 12 corresponds generally to the spacing between panels 13, 14, provided by spacer 15 so that such mating is retained and the cartridge is maintained in a sliding motion that carries or extends it in a direction out of either open end 23, 24 of its sleeve 11, and along no other axis of motion, i.e., the cartridge is prevented from moving or sliding in an skewed direction including, the direction towards the open top 16 of sleeve 11, while it is stabilized in its sliding position.

Such sliding motion, in either direction, i.e., through either open end 25, 26, is limited by restricting the extent of projection of cartridge to sleeve, to prevent the cartridge from sliding or slipping completely out of its sleeve. This restriction is provided by the cooperative engagement of stop members 33, 34 that are configured as raised portions in their corresponding top edges 17, 18 of panels 13, 14, respectively, with ears 35, 36, in the form of lugs or bosses, that are fixedly mounted to their corresponding sides 27, 28, of and immediately adjacent a top edge 37 for cartridge 12. Although FIGS. 2, 3, 5, 6 and 7 may provide the appearance that ears 35, 36 are formed as part of a finger control member 38 that constitutes an actuating means to slide cartridge to sleeve through the latter's open ends 25, 26, it should be understood that each ear 35, 36 is positioned on its corresponding side 27, 28 of cartridge 12 independently of the positioning of member 38 on its cartridge. Each ear 35, 36 lies in the plane of a corresponding panel 13, 14 while being positioned in alignment at their corresponding opposing stops 33, 34 formed in the same corresponding panel 13, 14, in order to restrict the extent of the sliding motion between cartridge and sleeve and thereby prevent the two from being separated.

The serrated handle member 38 is fixedly mounted along, and preferably formed to and with, a top edge 37 of the cartridge 12, for manually sliding the cartridge in and out of the open ends 25, 26 of sleeve 11, by reason of the cooperative engagement of the ribs 31, 32 with their corresponding grooves 21, 22. The top edge 37 generally aligns with the tops of stop members 33, 34 in the assembly of cassette to sleeve.

Turning to FIGS. 2–6, cartridge 12 comprises a plurality of slotted formations or slots 43 for variously sized coins, such as pennies, nickels, dimes, and quarters. Each of the slots 43 includes a single annular coin-holding groove 44 which extends to and from an open end 45 for its slot. The slots 43 are formed in cassette 12 such that their open ends 45 face their corresponding side edge 46, bottom edge 47, and side edge 48 of the cassette, as the case may be.

In the illustrated embodiment, a pair of slots **43*q* (for quarters) are positioned between the cartridge's top edge 37 and the ribs 31, 32, the open end 45 of each facing an opposing side edge 46, 48 of the cassette. A pair of slots 43*d* (for dimes) are arranged in parallel to each other and positioned between the ribs 31, 32 and the bottom edge 47, their open ends 45 facing the same side edge 46. A slot 43*p* (for pennies) and a pair of slots 43*n* (for nickels) are arranged in parallel to each other and positioned between the ribs 31, 32, their open ends 45 facing the bottom edge 47** of the cassette. Thus this embodiment provides for retention of four (4) kinds of U.S. coinage. It is to be understood, however, that the numbers and sizes of slots, their arrangements relative to themselves and their positioning in the cassette itself are not to be considered to be limited to the precise configurations of the drawing illustrations or misconstrued to be the only embodiment of the invention being described herein.

A wedge or pillow 50, FIGS. 4, 5, 6, is integrally formed at the inner closed end of each slot. The inclination at a suitable angle for the pillows 50 extends inwardly of the slot's spacing into which coins are to be retained or stored. As viewed in FIGS. 4 and 5, the one edge 51 at the bottom of the pillow's inclination is flush with the one rail 54 in the body formation for the singular annular groove 44 forming its slot, while the inclination's other or upper edge 53 integrates or meets with the body formation forming the groove 44, below the other rail 52 in the body formation for the singular annular groove 44. The spacing between the rails 52, 54 that form annular groove 44 is more than the thickness of any coin 55 in order to provide for the slanting of the coins while they are retained in their slots, and which of course provides the wedging of one coin after another to be seated on a predeposited coin in a given slot. Thus the thickness of a particular coin doesn't prevent such seating of one coin on the next, as illustrated in FIG. 4. While seating upon the pillow 50 of its correspondingly-sized slot, a particularly-sized coin 55 therefore and the ones seated upon it became wedged in its particular slot 43. The coin's one side lies flat upon the pillow, FIGS. 5, 6.

In operation, the thumb and forefinger of a user's hand is applied to element 38 while the other hand of the user grasps the sleeve 11, with its thumb gripping the serrated thumb pad 19 of the sleeve 11. As element 38 pushes or projects cartridge 12 in either direction through one of the open ends 25, 26 of sleeve 11, the slotted formations on at least two of the three sides 46, 47, 48 are exposed, for dispensing or inserting coins 55 in their correspondingly-sized slots. In the one direction of the sliding movement, the slots **43*d*, 43*q* and slot 43*p* are exposed to their greatest depths along side edge 48 and bottom edge 47, respectively, of cartridge 12, as ear 36 engages its stop member 34. In the other direction of sliding motion, slot 43*q* and slots 43*n* are exposed to their greatest depths along side edge 46 and bottom edge 47, respectively, of cartridge 12, as ear 35 engages its stop member 33. In any one of these actions, a coin may be dispensed from or inserted into its correspondingly-sized slot. It should be apparent that engagement of either ear to its stop member need not be involved in each instance of use, as a slot 43** may be full or slightly full, or empty or slightly empty, of its coins so that insertion or dispensing of one or more coins may take place without the ears and stop members engaging one another.

In assembly, the wall panels 13, 14 are expanded outwardly of each other, after which the ribs 31, 32 of cartridge 12 are caused to enter their corresponding grooves 21, 22 in the sleeve 11, and the depending ears 35, 36 are able to pass by the upstanding stops 33, 34. The snap-back characteristic of panels 11, 12 then align their edges 17, 18 with the ears 35, 36, and assembly is completed.

The preferred material for cassette 10 is plastic, and say be made by state-of-the art techniques presently known in the plastic injection molding art. Other suitable material, for example, metal, may be utilized, either completely, or partially with regard to plastic material.

Various changes and modifications may be made without departing from the spirit of the inventive concept and the scope of protection afforded by the appended claims hereto.

This article has usefulness in the coin area of activity, whereby coins may be securely kept, rather than loosely contained in a person's pocket or purse.

I claim:

1. A coin cassette comprising a sleeve having spaced panels joined together by a spacer member at a bottom of the sleeve, said panels having edges forming an open top and at least one set of side edges forming at least one extending from the open top towards the spacer member, a cartridge including at least one slotted formation for coins and being slidably mounted within said spaced panels, and means for maintaining the relative sliding between said sleeve and said cartridges in a direction towards and through said one open end.

2. The cassette of claim 1 including means for actuating the sliding motion of said cartridge.

3. The cassette of claim 2 wherein said cartridge includes a top edge, said actuating means comprising a handle mounted on said top edge.

4. The cassette of claim 1 including means for gripping the sleeve mounted on said sleeve.

5. The cassette of claim 4 wherein said gripping means comprises a serrated thumb pad.

6. The cassette of claim 1 wherein said maintaining means comprises at least one rib mounted on said cartridge and a cooperating groove therefor included in said sleeve.

7. The cassette of claim 6 including means for gripping the sleeve mounted on said sleeve.

8. The cassette of claim 7 wherein said gripping means comprises a serrated thumb pad.

9. The cassette of claim 1 wherein said maintaining means comprises a pair of ribs and a corresponding cooperating pair of grooves on said cartridge and sleeve, respectively.

10. The cassette of claim 9 including means for gripping the sleeve mounted on said sleeve.

11. The cassette of claim 10 wherein said gripping means comprises a serrated thumb pad.

12. The cassette of claim 9 including means for actuating the sliding motion of said cartridge through said one open end.

13. The cassette of claim 12 wherein said cartridge includes a top edge and said actuating means comprises a handle mounted on said top edge.

14. The cassette of claim 13 including means for gripping the sleeve mounted on said sleeve.

15. The cassette of claim 14 wherein said gripping means comprises a serrated thumb pad.

16. An assembled coin cassette comprising a sleeve having spaced panels and a cartridge slidably mounted between said spaced panels, said cartridge having sides, a top edge, and a plurality of slotted formations for coins, said sleeve including edges forming an open top and opposing open ends, and including aligned grooves in its panels extending between its open ends, stop means mounted on each of said edges of said sleeve, said cartridge including ribs slidably engaging said grooves, means mounted on the top edge of said cartridge for actuating in either direction of the open ends the sliding motion of the cartridge, and means mounted on said cartridge for engaging each of said stop means to restrict the extent of the sliding motion of the cartridge towards either of the open ends.

17. The coin cassette of claim 16 wherein said stop means comprises a raised portion on each of the edges forming the open top of said sleeve and said engaging means comprises an ear mounted on each of said sides of said cartridge.

18. The coin cassette of claim 16 wherein said actuating means comprises a handle mounted on said top edge.

19. The coin cassette of claim 18 wherein said stop means comprises a raised portion on each of the edges forming the open top of said sleeve and said engaging means comprises an ear mounted on each of said sides of said cartridge.

20. The cassette of claim 16 including means for gripping the sleeve mounted on said sleeve.

21. The cassette of claim 20 wherein said gripping means comprises a serrated thumb pad.

22. A coin cassette comprising a sleeve, a cartridge having a top edge and at least one slotted formation for a coin, said sleeve having spaced panels and including an open top and at least one set of side edges forming an open end extending to the open top, said cartridge slidably mounted between said panels, means for preventing the cartridge from sliding in a skewed direction and stabilizing the cartridge's sliding position, said sleeve including at least one stop on one of its panels at its open top, and means fixedly mounted on said cartridge for engaging one said stop to limit the extent of sliding motion of the cartridge in the sleeve as said cartridge slides towards said open end in a direction for such engagement by said engaging means with said stop.

23. The cassette of claim 22 wherein said preventing means comprises a groove in one of the wall panels and a rib mounted on the cartridge cooperatively engaging said groove.

24. The cassette of claim 25 including means for actuating the sliding motion of the cartridge.

25. The cassette of claim 24 including means for gripping the sleeve mounted on said sleeve.

26. The cassette of claim 25 wherein said gripping means comprises a serrated thumb pad.

27. The cassette of claim 24 wherein said actuating means comprises a handle mounted on the top edge of the cartridge.

28. The cassette of claim 27 including means for gripping the sleeve mounted on said sleeve.

29. The cassette of claim 28 wherein said gripping means comprises a serrated thumb pad.

30. A coin cassette comprising a sleeve, a cartridge having at least one slotted formation for a coin or plurality of coins, said sleeve having spaced panels and an open top and having at least one set of side edges on said panels forming an open end extending to the open top and further including at least one groove in one of its panels, said cartridge slidably mounted between said panels and extendable out of said open end and including a rib slidably engaging one said groove, said sleeve further including at least one stop in one of its panels at its open top, and means fixedly mounted on said cartridge for engaging one said stop to restrict the sliding motion of the cartridge when it slides towards said open end in a direction providing for such engagement by said engaging means with said stop.

31. The cassette of claim 30 including means for gripping the sleeve mounted on said sleeve.

32. The cassette of claim 31 wherein said gripping means comprises a serrated thumb pad.

33. The cassette of claim 30 including means for actuating the sliding motion of said cartridge towards the open end.

34. The cassette of claim 33 including means for gripping the sleeve mounted on said sleeve.

35. The cassette of claim 34 wherein said gripping means comprises a serrated thumb pad.

36. The cassette of claim 33 wherein said cartridge includes a top edge and said actuating means' comprises a handle mounted on said top edge.

37. The cassette of claim 30 wherein said sleeve includes a groove in its other of said panels, said cartridge including another rib cooperatively engaging the groove in the other of said panels.

38. The cassette of claim 30 wherein said sleeve includes a second set of side edges forming a second open end, said cartridge extendable out of the second open end, another stop mounted on the other of said panels at the sleeve's open top, and a second means fixedly mounted on said cartridge for engaging the stop mounted on the other of said panels to restrict the sliding motion of the cartridge as it slides towards the second open end in a direction providing for the engagement by the second means with the stop mounted on the other of said panels.

39. The cassette of claim 38 including means for gripping the sleeve mounted on said sleeve.

40. The cassette of claim 39 wherein said gripping means comprises a serrated thumb pad.

41. The cassette of claim 30 wherein the slotted formation has a closed end and includes an angled pillow mounted at said closed end for seating a coin thereon, each subsequent coin deposited in the slotted formation being seated upon an immediately pre-deposited coin and being wedged and retained in the slotted formation.

42. The cassette of claim 41 including means for actuating the sliding motion of said cartridge towards the open end.

43. The cassette of claim 42 including means for gripping the sleeve mounted on said sleeve.

44. The cassette of claim 43 wherein said gripping means comprises a serrated thumb pad.

45. The cassette of claim 42 wherein said cartridge includes a top edge and said actuating means comprises a handle mounted on said top edge.

* * * * *

UNITED STATES PATENT AND TRADEMARK OFFICE

CERTIFICATE OF CORRECTION

PATENT NO. : 5,353,924

DATED : October 11, 1994

INVENTOR(S) : JAFFEE, Max

It is certified that error appears in the above-identified patent and that said Letters Patent is hereby corrected as shown below:

In column 5, line 32, read "one extending" as

- - one open end extending - - .

In column 5, line 38, read "cartridges" as - - cartridge - - .

Column 5, line 39, read "said one" as —one said—.

Column 7, line 4, read "claim 25" as —claim 23—.

In column 8, line 4, read " means' " as - - means - - .

Signed and Sealed this

Twentieth Day of December, 1994

*Attest:*

Bruce Lehman

BRUCE LEHMAN

*Attesting Officer*

*Commissioner of Patents and Trademarks*